US006303077B1

(12) United States Patent
Arvidsson et al.

(10) Patent No.: US 6,303,077 B1
(45) Date of Patent: Oct. 16, 2001

(54) METHOD OF MONITORING AND CONTROLLING THE COMPOSITION OF SINTERING ATMOSPHERE

(75) Inventors: Johan Arvidsson, Nyhamnsläge; Ola Eriksson, Höganäs, both of (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/448,491

(22) Filed: Nov. 24, 1999

Related U.S. Application Data

(63) Continuation of application No. PCT/SE98/01009, filed on May 27, 1998.

(30) Foreign Application Priority Data

May 27, 1997 (SE) ..... 9701976

(51) Int. Cl.[7] ..... B22F 3/12
(52) U.S. Cl. ..... 419/57; 73/23.2; 73/31.03
(58) Field of Search ..... 419/38, 57; 73/23.2, 73/31.03

(56) References Cited

U.S. PATENT DOCUMENTS

| | | | |
|---|---|---|---|
| 4,028,100 | | 6/1977 | Latva . |
| 4,153,485 | | 5/1979 | Ogata et al. . |
| 4,891,246 | | 1/1990 | McEwen et al. . |
| 5,892,164 | * | 4/1999 | Garg et al. ..... 75/246 |

FOREIGN PATENT DOCUMENTS

| | | |
|---|---|---|
| 0038558A1 | 10/1981 | (EP) . |
| 0105138A1 | 4/1984 | (EP) . |
| 0503326A | 9/1992 | (EP) . |
| 09263801A | 10/1997 | (JP) . |

* cited by examiner

*Primary Examiner*—Daniel J. Jenkins
(74) *Attorney, Agent, or Firm*—Burns, Doane, Swecker & Mathis, L.L.P.

(57) ABSTRACT

The invention concerns a method of monitoring and controlling the furnace atmosphere when sintering PM compacts. According to the invention, the gases determining the carbon and oxygen potentials are measured continuously.

19 Claims, 4 Drawing Sheets

Figure 1:
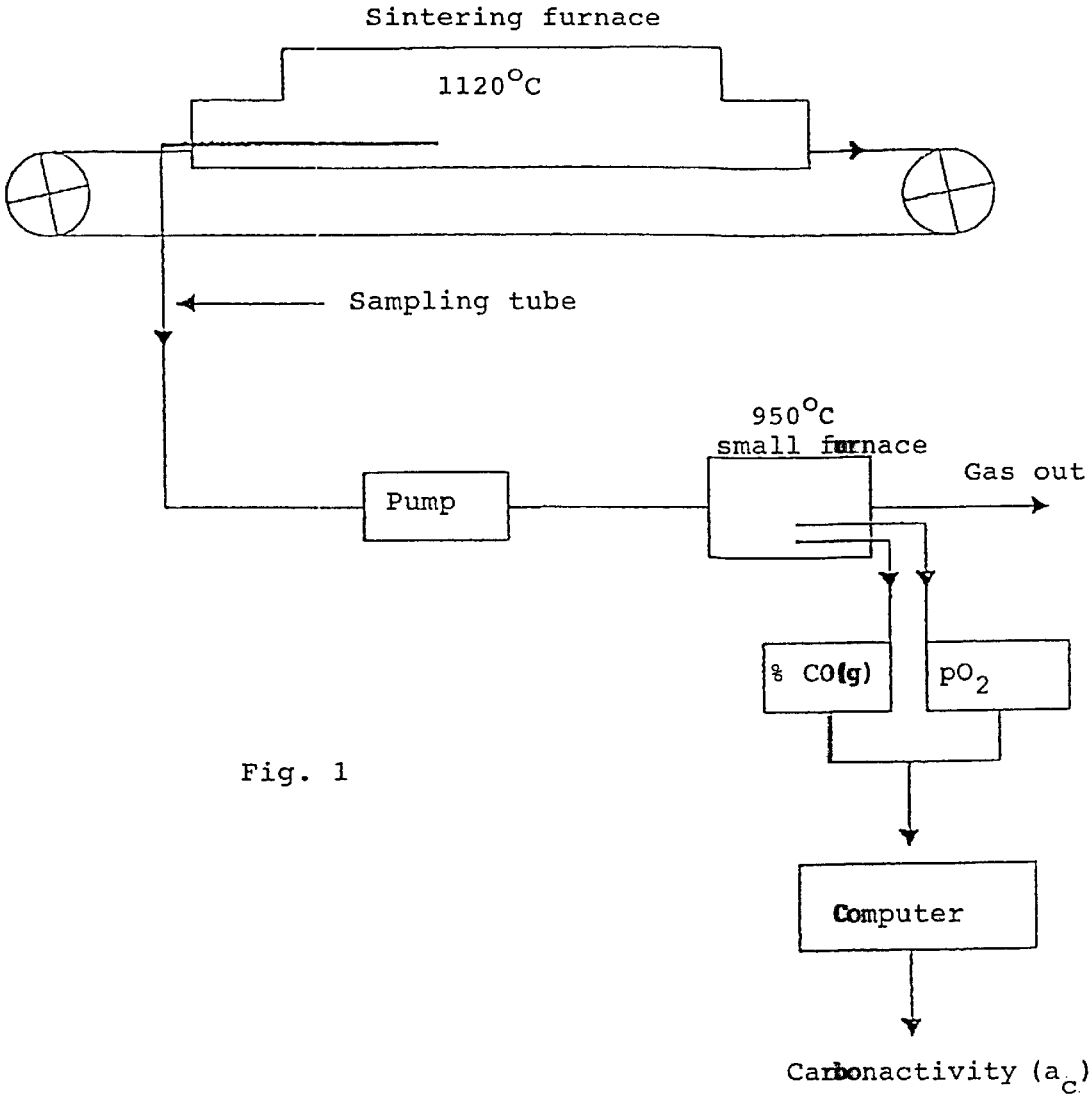

| | |
|---|---|
| Pressure: | 1.000 bar |
| Raw Materials: | mol |
| H2(g) | 4.4598E-01 |
| N2(g) | 4.0150E+00 |
| O2(g) | 4.4616E-22 |
| CO(g) | 4.4616E-12 |
| H2O(g) | 4.4616E-05 |
| CH4(g) | 2.9893E-02 |

METHOD OF MONITORING AND CONTROLLING THE COMPOSITION OF SINTERING ATMOSPHERE

This is a continuation of International Application No. PCT/SE98/01009, filed May 27, 1998, that designates the United States of America and which claims priority from Swedish Application No. 9701976-4, filed May 27, 1997.

The present invention concerns a method of sintering powder-metallurgically produced compounds. More specifically, the invention concerns a method of monitoring and controlling the composition of the sintering atmosphere.

Currently with the development of newer and better powder-metallurgical products there is a need of improved methods of controlling also the sintering atmosphere, and the object of the present invention is to meet this need.

In brief the present invention concerns a method of controlling and monitoring the furnace sintering atmosphere when sintering powder-metallurgical (PM) compacts, gases determining the carbon and oxygen potentials being measured continuously.

The invention is of special interest for monitoring and controlling the atmosphere during sintering of compacts of low-alloy iron-based materials including easily oxidable alloying elements selected from the group consisting of Cr, Mn, Mo, V, Nb, Zr, Ti, Al in order to keep the oxidation of these elements at a low level.

There is a wide variety of instruments for analysing and controlling the gases used in atmospheres for powder metallurgy, and the composition of the atmospheres used in sintering is determined either by insitu or by room temperature measurements. The measurements can also be performed in separated chamber, into which the furnace gases are extracted from the sintering furnace.

According to the invention, the oxygen potential is determined by using oxygen probes which are applied in the furnace muffle via the furnace wall or in the separate chamber or furnace and operate with a stabilised $ZrO_2$ cell. A reference gas (normally air) with a well defined partial pressure of oxygen penetrates one side of the cell, whereas the other side of the cell is in contact with the furnace atmosphere. The difference in partial pressure of oxygen creates an electric potential which is monitored, thereby defining the oxygen potential present. If the electric potential measured, which corresponds to the actual sintering atmosphere, differs from a set value, necessary atmosphere adjustments are performed. The set value for the sintering of a given material is decided empirically or theoretically and depends on the type and amount of the alloying elements. When using oxygen probes one has to consider that especially atmospheres with high carbon potentials tend to form soot on the $ZrO_2$ cell if necessary precautions are not taken, thereby preventing effective atmosphere control. Many producers have now foreseen such problems and equipped the oxygen probes with, for instance, mechanical brushes.

The oxygen probe can be applied in different places when controlling the atmosphere. In a belt furnace based on the countercurrent principle, the oxygen probe is preferably arranged in the end of the sintering zone where the "fresh" gas enters.

A second alternative is to arrange the probe close to the inlet of the furnace. For this alternative,it has to be taken into account that the oxygen potential might be higher due to possible reduction of oxides and burn-off of lubricants, and therefore the acceptable oxygen level in this part of the furnace has to be found by "trial and error" for each powder alloy.

As a third alternative the, oxygen probe can be arranged in a separate chamber or furnace into which the gases from the sintering furnace are extracted. In this alternative the oxygen probe is arranged in a separate chamber into which the gases from the sintering furnace are extracted. The temperature of the atmosphere in this chamber is optionally the same as the temperature of the furnace atmosphere. When the temperature of the atmosphere in the separate measuring chamber is different from the temperature of the sintering furnace atmosphere this temperature difference must be considered when determining the gas composition of the sintering furnace.

The natural constraint with regard to oxygen is that the measured oxygen potential shall be kept or set below the value for the equilibrium partial pressure of oxygen between the alloying elements and their oxides, e.g. Cr and $Cr_2O_3$. The equilibrium partial pressure of oxygen is well defined for any type of atmosphere used at a specific temperature. If the measured oxygen value is close to this set-point, a natural counteraction is to increase the flow of reducing gas, e.g. $H_2$. As can be seen from Example 3 below, the oxygen level can also be controlled and adjusted to a required value by the introduction of a carbon-containing gas, such as methane.

It is still more common to monitor sintering conditions by room temperature measurement of the gas mixture. This measurement is generally based on either infrared analysis and/or dew point monitoring.

The infrared analysis is based on the principle that different gases absorb infraredenergy at characteristic wavelengths. If the concentration of a single component in a gas mixture is changed, it will result in a corresponding change in the total energy remaining in an infrared beam passed through the mixture. The energy changes, which are detected by an infrared analyser, are therefore a measure of the gas concentration. Each gas compound absorbs a certain portion of the infrared spectrum which no other gas absorbs, and the amount of radiation absorbed is proportional to the concentration of the specific gas. Typical applications of infrared analysers are in the field of gases with high carbon potential, and care has to be taken when the atmosphere is sampled in order to avoid soot formation and/or condensation.

The determination of the carbon potential comprises measuring the partial pressure of oxygen in combination with the measurement of one or more of the carbon-containing gases, such as carbon monooxide, thereby determining the carbon potential. Another alternative is to measure the concentration of all or all but one carbon-containing gases. The measurements are carried out on gases from the sintering zone, the cooling zone and/or the heat treatment zone.

The control and monitoring of the sintering atmosphere by measuring the oxygen and carbon potentials according to the present invention is preferably carried out by using a combination of an oxygen probe for measuring the oxygen potential and an IR instrument which concurrently measures the carbon-containing gases such as CO, $CO_2$ and methane. By using such a combination, the influence of the carbon-containing gases on the oxygen potential is taken into account and a superior method of controlling and monitoring the sintering atmosphere is obtained. By using this method, optimal sintering conditions can be maintained and the properties of the sintered materials will be improved.

Also the C potential is kept at a set value This set value depends on the desired carbon level in the sintered material.

The method according to the invention can be applied to all types of sintering atmospheres such as nitrogen-based atmospheres, dissociated ammonia, hydrogen-based atmospheres, endothermic gas etc. and within sintering temperatures between 1050 and 1350° C.

A preferred embodiment of the invention concerns a method of monitoring and controlling the atmosphere during sintering of compacts of low-alloy iron-based materials including easily oxidisable alloying elements selected from the group consisting of Cr, Mn, Mo, V, Nb, Zr, Ti, Al, in a belt furnace.

The invention is further illustrated by the following non-limiting examples.

EXAMPLE 1

This example illustrates that the influence of the oxygen potential as measured with an oxygen probe is in accordance with theoretical calculations. The oxygen probe used was Econox: Type 1000 from Econox S.A. (Switzerland).

Powder compacts containing prealloyed iron powder containing 3% Cr and 0.5% Mo were sintered 45 minutes in an atmosphere based on various $H_2(g)/H_2O(g)$ ratios at 1120° C. The oxygen probe was arranged close to the inlet of the furnace. The results from three tests with different sintering gas composition are disclosed in the following table.

| | Test 1 | Test 2 | Test 3 |
|---|---|---|---|
| Measured oxygen probe $pO_2$ (atm) | $2.6 \cdot 10^{-18}$ | $5.6 \cdot 10^{-18}$ | $3.4 \cdot 10^{-17}$ |
| Oxygen content 3% Cr, 0.5% Mo | 0.02% | 0.04% | 0.14% |
| Gas mix | 0.25 $Nm^3$ wet $H_2$ + 9.75 $Nm^3$ dry $H_2$ | 1.0 $Nm^3$ wet $H_2$ + 9.0 $Nm^3$ dry $H_2$ | 2.0 $Nm^3$ wet $H_2$ + 8.0. $Nm^3$ dry $H_2$ |

The results from the 3 tests show that a more pronounced oxidation occurs for oxygen potentials exceeding $3.4.10^{-17}$ atm, which is in accordance with theoretical calculations which show that the oxygen potential should not exceed $4.6.10^{-17}$ atm as can be seen from the following equations:

$$2Cr\ (s)+3/2O_2=Cr_2O_3 \qquad \text{Reaction No. 1}$$

$$\Delta G_1^0 = 62.1 \cdot T - 267750 \left[\frac{cal}{mol}\right] \quad T = \text{temperature(K)}$$

$$2\underline{Cr}+3/2O_2=Cr_2O_3 \qquad \text{Reaction No. 2}$$

According to "Treatment of Metallurgical Problems", p.256, the change in Gibbs' energy due to dissolving chromium in an iron matrix is described and quantified by the equation:

$$\Delta G(Cr)=6000 \cdot N_{Fe} \cdot N_{Cr} - T \cdot (2.4-3.6 \cdot N_{Cr}) \text{ for the reaction no. 3}$$

$$Cr(s)=Cr \text{ (pure, solid Cr} \rightarrow \text{Cr in solid solution)}$$

The net reaction no. 2 is obtained by subtracting reaction No. 3 from reaction No. 1, which in turn means that $\Delta G_0{}^2{}_0=\Delta G_0{}^1{}_0-2\ \Delta G(Cr)$. Applying this on a material containing 3% chromium;

$$N_{Fe}=0.95\ N_{Cr}=0.031;\ \Delta G(Cr)=6000\ N_{Fe} \cdot N_{Cr} - T(2.4 \cdot 3.6 N_{Cr})$$

$$\Delta G(Cr) = -3.001 \cdot 10^3 \frac{cal}{mol} \quad \Delta G_1^0 = 59730.3$$

$$\Delta G_2^0 = \Delta G_1^0 - 2 \cdot \Delta G(Cr) \quad \Delta G_2^0 = -1.752 \cdot 10^5 \frac{cal}{mol}$$

Approximate ideal solution:

Equilibrium between metal and oxide ⇒

$$\Delta G_2 = \Delta G_2^0 - RT\ln\left(\frac{a_{Cr_2O_1}}{a_{\underline{Cr}}^2 \cdot P_{O_2}^{3/2}}\right) = 0$$

$$\Rightarrow \Delta G_2^0 - RT\ln\left(\frac{a_{Cr_2O_1}}{a_{\underline{Cr}}^2 \cdot P_{O_2}^{3/2}}\right)$$

$$a_{Cr} = N_{Cr} = 0.032$$

$$pO_2 = \left(\frac{1}{a_{\underline{Cr}}^2} \exp \frac{\Delta G_2^0}{RT}\right)^{\frac{2}{3}} \Rightarrow pO_2 = 4.614 \cdot 10^{-17} \text{ atm}$$

$\Delta G^2{}_0$=Gibbs free energy change for reaction No. 2 formation of $Cr_3O_3$ from dissolved Cr and oxygen gas.

Abbreviations:

$\Delta G^0 1$=Gibbs' free energy change for reaction No. 1 formation of $Cr_2O_3$ from pure Cr and oxygen gas (cal/mol)

$\Delta G(\underline{Cr})$=Gibbs' free energy change for dissolving Cr in iron matrix $N_{Fe}$ and $N_{cr}$ denote molar fraction of Fe and Cr, respectively $a_{Cr}$ denotes activity of chrome

EXAMPLE 2

This example illustrates the invention for on-line control of the atmosphere in a production furnace. The example shows the possibility of extracting gas from the sintering zone and carrying out the analyses in a small separate furnace placed close to the production furnace or chambers (see FIG. 1).

Data for the production furnace, atmosphere and sintered material used:

a) Meshbelt furnace manufactured by Efco, 200 KW, belt width=450 mm, approx. 40 m length, b) 5 Temperature zones: 600, 650, 700, 1120, 1120 and 1120 C.

c) Sintered material: Iron powder, 0.7% C, 1.5% Cu and 0.8% H-wax, 150 kg/h.

d) Atmosphere: 10% $H_2(g)$/90% $N_2(g)$+X% $CH_4(g)$ (0<X<2%) depending on the desired carbon potential.

e) Sintering time: approximately 25 min at 1120° C.

For the mentioned sintering trial, the $CH_4(g)$ addition was aimed to produce sintered material with a carbon content of 0.7% (uniformly through each sintered part).

A 7 m long and thin steel tube (6 mm outer diameter and 3 mm inner diameter) was inserted into the entrance opening of the furnace. The tube was connected to the sampling system via a pump and the tube length allowed for gas extraction in the high temperature zone of the furnace (1120° C.). The set up is illustraded in FIG. 1.

Figure 2:
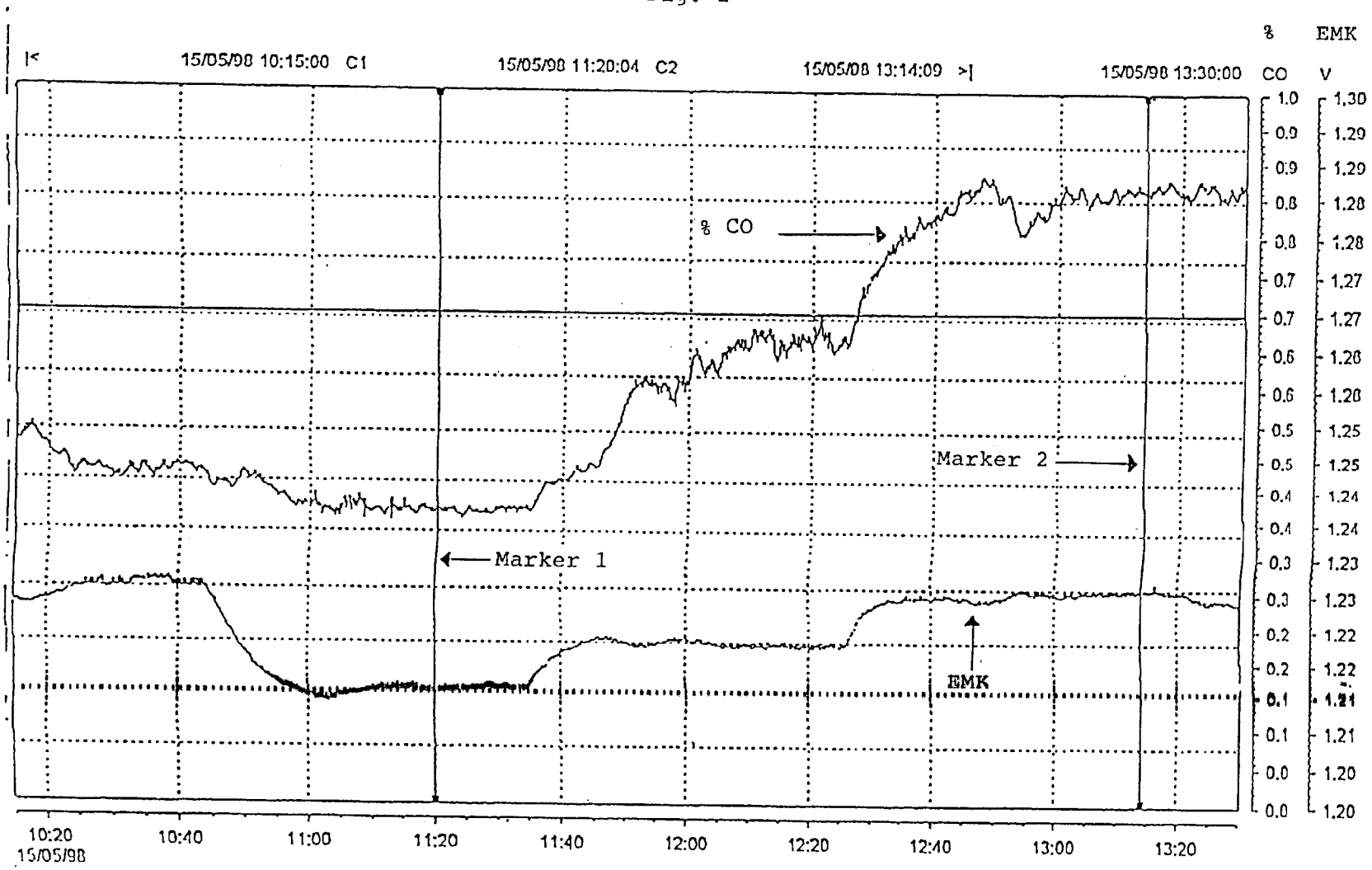

The gas composition and carbon potential were continuously monitored by measuring the oxygen potential and CO(g) concentration (see FIG. 2).

At 11.20 (marker 1) it is found that % CO≈0.41 and EMK≈1215 mV, which according to the calculation below gives a carbon potential=0.22.

In order to increase the carbon potential, the amount of $CH_4(g)$ was increased and consequently higher CO- and EMK-values were measured after a certain time. At 13.15 we find that the raised CO-level≈0.85 and EMK=1230 mV leading to a carbon potential of ≈0.6. Sintered material from the two mentioned periods was analysed with respect to carbon content and the results revealed the difference with respect to atmosphere conditions.

As expected, the decarburizing effect was more pronounced for material sintered in an atmosphere with a carbon potential=0.21 in comparison with material sintered in a carbon potential=0.6.

RESULTS:

a) Carbon potential=0.21 Surface hardness=160 Vichers ($HV_5$), carbon content at surface in the range of 0.2–0.3.

b) Carbon potential=0.6 Surface hardness=185 Vickers ($HV_5$), carbon content at the surface in the range of 0.4–0.55.

Calculation

1) $LogPo_2=-0.678-EMK/(0.496*T)$ where T is the probe temperature (Kelvin)

Relation between carbon concentration (wt %) and activity of carbon.

2) $a_c=\gamma Xc/(1-2\ Xc)$ where Xc is the molar fraction of carbon in a Fe—C alloy and $\gamma=exp\ ((5115,9+8339,9\ Xc/(1-Xc)/T-1,9096)$ 3) For the reaction $C=\frac{1}{2}\ O_2(g)\rightarrow CO(g)$ the following equation can be deduced ($C=a_c$ in gas phase).

$K=Pco(g)/\sqrt{Po_2}*a_c$ where K=f(T)

By using eq. 1–3 and measuring $Po_2$ and % Co, it is possible to calculate the carbon activity ($a_c$) as shown in Example 2.

Figure 3:
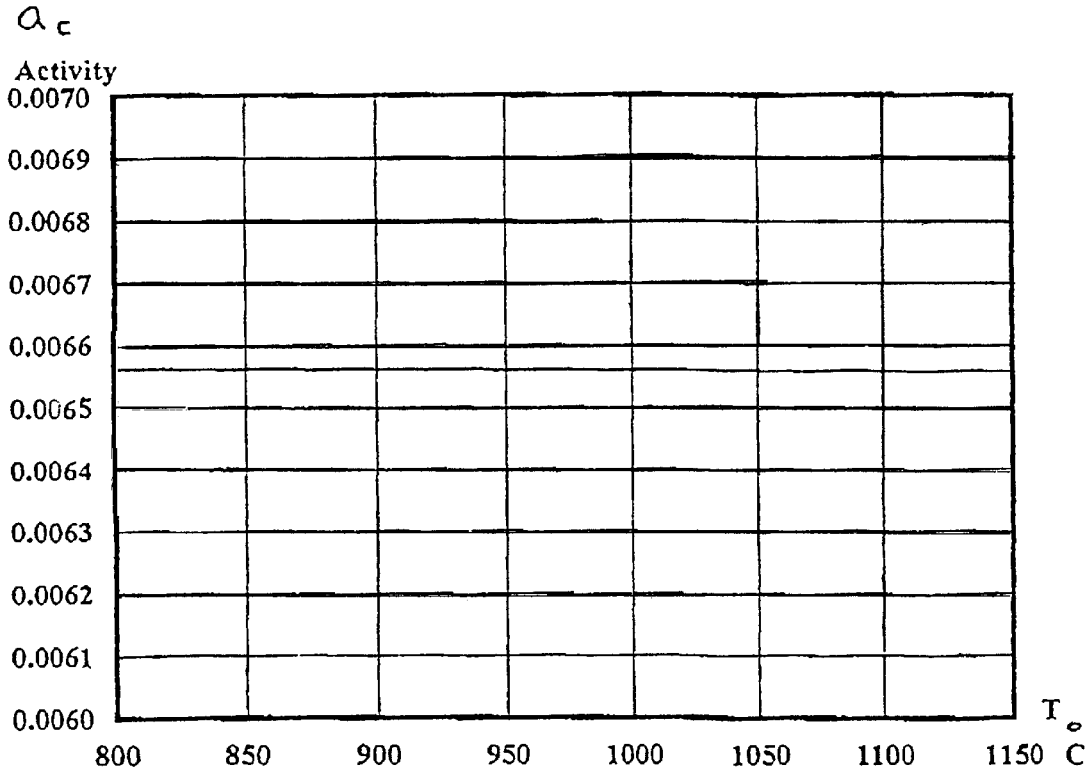

For a $N_2$—$H_2$—$CH_4$ mixture, the carbon activity is almost independent of temperature (see FIG. 3) and thus the mentioned relations are very easy to apply to a sampling system where the gas monitoring is conducted in a separate small furnace at a temperature different from the one used for sintering.

EXAMPLE 3

Figure 4:
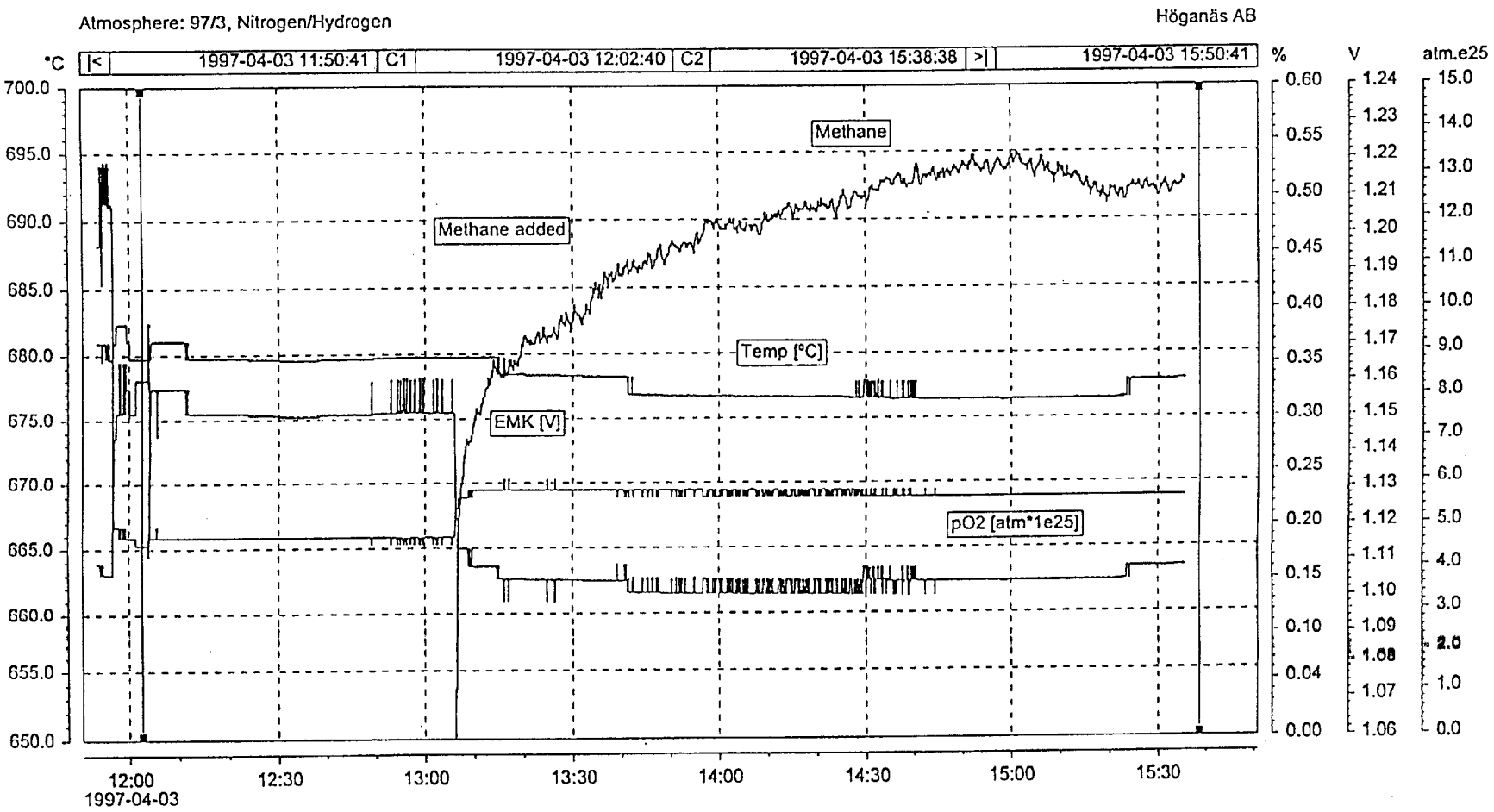

This example discloses the influence of the addition of methane on the oxygen potential in a sintering atmosphere consisting of 97/3 nitrogen/hydrogen. As can be seen from FIG. 4, the oxygen potential is clearly influenced by the addition of methane to the sintering atmosphere.

As in Example 1, the oxygen potential was measured by the probe Econox Type 1000. The methane concentration was measured by an IR analyzer supplied by Maihak (Germany).

It is obvious that the contemporary measurement of the C and O potentials according to the invention permits a superior control of the sintering atmosphere, which is especially advantageous when sintering low-alloy components containing easily oxidisable elements. This careful control is necessary, inter-alia, for obtaining a small variation of the dimensional change during sintering as well as a neglible scatter in mechanical properties of the sintered components.

What is claimed is:

1. A method of monitoring and controlling a furnace atmosphere when sintering powder-metallurgical compacts, comprising continuously measuring gases to determine the oxygen and carbon potentials in a furnace zone selected from the sintering zone, the cooling zone and/or the heat treatment zone, wherein the determination of the oxygen and carbon potentials comprises measuring the oxygen partial pressure.

2. A method of monitoring and controlling a furnace atmosphere when sintering powder-metallurgical compacts, comprising continuously measuring gases to determine the oxygen and carbon potentials in a separate chamber from the sintering furnace, into which the gases are extracted from the sintering furnace, wherein the determination of the oxygen and carbon potentials comprises measuring the oxygen partial pressure.

3. The method according to claim 1, wherein the sintering is not performed at a reduced pressure.

4. A method of monitoring and controlling a furnace atmosphere when sintering powder-metallurgical compacts, comprising continuously measuring gases to determine the oxygen and carbon potentials in a furnace zone selected from the sintering zone, the cooling zone and/or the heat treatment zone, wherein the oxygen potential is determined by an in situ measurement.

5. A method of monitoring and controlling a furnace atmosphere when sintering powder-metallurgical compacts, comprising continuously measuring gases to determine the oxygen and carbon potentials in a furnace zone selected from the sintering zone, the cooling zone and/or the heat treatment zone, wherein the oxygen partial pressure is measured with an oxygen probe.

6. A method of monitoring and controlling a furnace atmosphere when sintering powder-metallurgical compacts, comprising continuously measuring gases to determine the oxygen and carbon potentials in a furnace zone selected from the sintering zone, the cooling zone and/or the heat treatment zone, wherein the measurement of the carbon potential comprises measuring the oxygen partial pressure with an oxygen probe and the concentration of at least one carbon-containing gas with an IR analyzer.

7. The method according to claim 1, wherein the oxygen level is kept at a value below the equilibrium value for the formation of the metal oxide, and the carbon potential is kept at a set value depending on the desired carbon potential in sintered material.

8. The method according to claim 1, wherein the compacts are low-alloy iron-based materials including easily oxidizable alloying elements selected from the group consisting of Cr, Mn, Mo, V, Nb, Zr, Ti and Al.

9. The method according to claim 1, wherein the sintering is carried out in a belt furnace.

10. The method according to claim 2, wherein the temperature of the separate chamber is different from the temperature of the sintering furnace.

11. The method according to claim 2, wherein the sintering is not performed at a reduced pressure.

12. The method according to claim 2, wherein the oxygen potential is determined by an in situ measurement.

13. The method according to claim 3, wherein the oxygen potential is determined by an in situ measurement.

14. The method according to claim 11, wherein the oxygen potential is determined by an in situ measurement.

15. A method of monitoring and controlling a furnace atmosphere when sintering powder-metallurgical compacts, comprising continuously measuring gases to determine the oxygen and carbon potentials in a separate chamber from the sintering furnace, into which the gases are extracted from the sintering furnace, wherein the oxygen partial pressure is measured with an oxygen probe.

16. A method of monitoring and controlling a furnace atmosphere when sintering powder-metallurgical compacts, comprising continuously measuring gases to determine the oxygen and carbon potentials in a separate chamber from the sintering furnace, into which the gases are extracted from the sintering furnace, wherein the measurement of the carbon potential comprises measuring the oxygen partial pressure with an oxygen probe and the concentration of at least one carbon-containing gas with an IR analyzer.

17. A method of monitoring and controlling a furnace atmosphere when sintering powder-metallurgical compacts, comprising continuously measuring gases to determine the oxygen and carbon potentials in a separate chamber from the sintering furnace, into which the gases are extracted from the sintering furnace, wherein the oxygen level is kept at a value below the equilibrium value for the formation of the metal oxide, and the carbon potential is kept at a set value depending upon the desired carbon potential in sintered material.

18. The method according to claim 2, characterised in that the compacts are low-alloy iron-based materials including easily oxidisable alloying elements selected from the group consisting of Cr, Mn, Mo, V, Nb, Zr, Ti and Al.

19. The method according to claim 2, characterised in that the sintering is carried out in a belt furnace.

* * * * *